US006422845B1

(12) United States Patent
Wong et al.

(10) Patent No.: US 6,422,845 B1
(45) Date of Patent: Jul. 23, 2002

(54) ROTARY HYDRAULIC VANE PUMP WITH IMPROVED UNDERVANE PORTING

(75) Inventors: Albert Cheuk-Yin Wong; Tom Cheuk-In Wong, both of Saginaw; Johnny M. Paris, Clio, all of MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/728,348

(22) Filed: Dec. 1, 2000

(51) Int. Cl.[7] ..... F03C 2/00

(52) U.S. Cl. ..... 418/133; 418/268; 418/269; 418/77; 418/81; 418/82

(58) Field of Search ..... 418/133, 268, 418/269, 77, 81, 82

(56) References Cited

U.S. PATENT DOCUMENTS

| | | | | | |
|---|---|---|---|---|---|
| 360,565 | A | * | 4/1887 | Dawson | |
| 3,207,077 | A | | 9/1965 | Zeigler et al. | |
| 3,761,206 | A | * | 9/1973 | Fierstine | 418/173 |
| 3,900,277 | A | * | 8/1975 | Newton | 418/236 |
| 4,386,891 | A | | 6/1983 | Riefel et al. | |
| 4,470,768 | A | * | 9/1984 | Konz | 418/133 |
| 4,484,863 | A | * | 11/1984 | Pagel | 418/268 |
| 4,681,517 | A | * | 7/1987 | Schulz et al. | 417/300 |
| 6,050,796 | A | | 4/2000 | Wong et al. | |

FOREIGN PATENT DOCUMENTS

| | | | | |
|---|---|---|---|---|
| CA | 515809 | * | 8/1955 | 418/133 |
| JP | 02-108881 | * | 4/1990 | 418/133 |

* cited by examiner

*Primary Examiner*—Thomas Denion
*Assistant Examiner*—Theresa Trieu
(74) *Attorney, Agent, or Firm*—Edmund P. Anderson

(57) ABSTRACT

The pump has a multi-vane rotor operating within a cam ring to pump oil to a component such as a power steering gear. The pump rotor sandwiched between stationary thrust and pressure plates is supplied with oil from a surrounding fluid chamber through aligned intake ports in the two plates. Fluid chambers formed between the reciprocating vanes of the rotor discharges oil into axially aligned discharge ports of the thrust and pressure plates. The discharge port of the thrust plate is hydraulically connected to the discharge port of the pressure plate . Pressure oil in the discharge port of the pressure plate feeds into a system pressure chamber outboard of the pressure plate. Oil in the system pressure chamber is fed back to a first side chamber of the rotor through at least one simple flow passage in the pressure plate. The first side chamber is formed between inner and outer lands on the rotor. A second side chamber is similarly formed on the opposite side of the rotor and is hydraulically interconnected to the first side chamber by the undervane passages. With the pump rotating, the undervane chambers are pressurized by the supply of pressure oil to the side chambers through the straight through passage in the pressure plate to assure engagement of the vanes with the operative surface of the cam ring.

5 Claims, 3 Drawing Sheets

ROTARY HYDRAULIC VANE PUMP WITH IMPROVED UNDERVANE PORTING

FIELD OF THE INVENTION

This invention relates to hydraulic power converting machines and more particularly to a new and improved multi-vane rotor pump for industrial or power steering use featuring improved undervane hydraulic fluid pressure porting for optimizing undervane pressurization for urging the vanes into operative engagement with the cam surface of an outer cam ring for improving pump operations.

DESCRIPTION OF THE PRIOR ART

Prior to the present invention various rotary hydraulic vane pumps have been devised with minute and complex hydraulic systems of interconnected pockets, passages and orifices in pump components including the thrust and pressure plates thereof to provide discrete flow paths for coupling the undervane passages with a pump discharge chamber. The hydraulic fluid in the undervane passages is pressurized on pump operation so that the pressurized undervane acts as a hydraulic spring for pump priming and pump operational purposes. More particularly the pressurized undervane fluid acts as a spring to exert a yieldable radial force on the vanes, mounted for reciprocal movement in associated vane slots, to maintain the fluid sealing contact of the tips of the vanes with the associated cam surface during pumping operation.

Examples of such undervane constructions are illustrated and described in U.S. Pat. No. 3,207,077 issued Sep. 21, 1965 to P. B. Zeigler et al for Pump and U.S. Pat. No. 4,386,891 issued Jun. 7, 1983 to R. P. Riefel et al for Rotary Hydraulic Vane Pump With Undervane Passages For Priming.

While such prior art hydraulic pumps have generally met their objectives in providing improved pumping for power steering and other applications, more efficient and effective pumps are needed to meet higher pumping efficiency standards. Moreover, manufacture of prior art pressure and thrust plates with their special and intricately interconnected fluid pockets are difficult and costly. Even with particular attention to detail and care, such construction cannot be readily accomplished by economical manufacturing processes such as casting and stamping operations. Generally such designs require the employment of complex powder metal forming tools and precise machining. Such tooling and procedures makes thrust and pressure plates expensive to produce, particularly where limited quantities are needed

SUMMARY OF THE PRESENT INVENTION

In contrast to the prior art constructions, the present invention provides a new and improved pump which has improved pumping efficiency. This invention incorporates straight forward and simplified vane pressurization porting in the pressure plates that can be readily manufactured by a wide range of processes and equipment including economical stamping and casting. Preferably in this invention a cam ring sandwiched between pressure and thrust plates hydraulically separates the pressure plate from the thrust plate to improve routing of hydraulic pressure fluid to the undervane via special openings in the pressure plate augmenting vane sealing operation. Furthermore, this invention with its improved pressure plate porting for undervane pressurization can be easily employed with a wide range of hydraulic vane pumps including those currently embodied in automotive application as well as transverse compact pumps and hydraulically balanced pump rotors such as disclosed in U.S. Pat. No. 6,050,796 issued to Wong et al. on Apr. 18, 2000 for Vane Pump and hereby incorporated by reference.

Preferably in this invention, a cam ring sandwiched between pressure and thrust plates blocks flow from the discharge ports in the pressure plate to the discharge ports in the thrust plate (and thereby to the pump discharge) to improve pressure routing to the undervane via special inner openings in the pressure plate. More particularly, hydraulic discharge from the pressure plate is primarily through a radial outer port to a sealed undervane pressure chamber at the outboard side of the rotor assembly. Pressure fluid is fed from this side chamber to a pair of interior rotor balancing chambers on opposite sides of the rotor which are hydraulically connected by the undervane passages. With the balancing chambers and the undervane pressurized, the radially extending vanes will be biased by the undervane pressure fluid into operative fluid sealing engagement with the cam surface of the surrounding cam ring.

It is a feature object and advantage of this invention to provide a new and improved rotary vane pump with a flattened pressure plate formed with at least one discharge port for feeding only a side chamber in the pump housing and at least one undervane feed port leading from the side chamber to opposing pressure balancing side chambers of the rotor so that all undervane passages will be pressurized to effect an outward force on the vanes therein for improved engagement of the vanes with an associated outer cam ring.

With the present invention, mechanical noises heretofore generated by some vane pumps will be sharply reduced by the elimination of the arcuate and segmented undervane grooves or other configured undervane recesses or quadrants that may be arranged in various geometric patterns in the faces of the pressure and thrust plates adjacent to the inner ends of the vane slots formed in the pump rotor. These grooves at times formed unintended contact points for any vane tipping in its respective vane groove and projecting out of the side of the rotor. Contact with such grooves by the comer or other parts of the vane resulted in objectionable ratcheting or ticking noises.

In addition to sharply reduced manufacturing costs and reduced noise generation this invention provides improved volumetric efficiency through better sealing between thrust and pressure plates and the rotor sandwiched therebetween.

These and other objects and advantages of the present invention will be more apparent from the following detailed description and drawings in which:

DESCRIPTION OF THE PREFERRED EMBODIMENT

Figure 1:
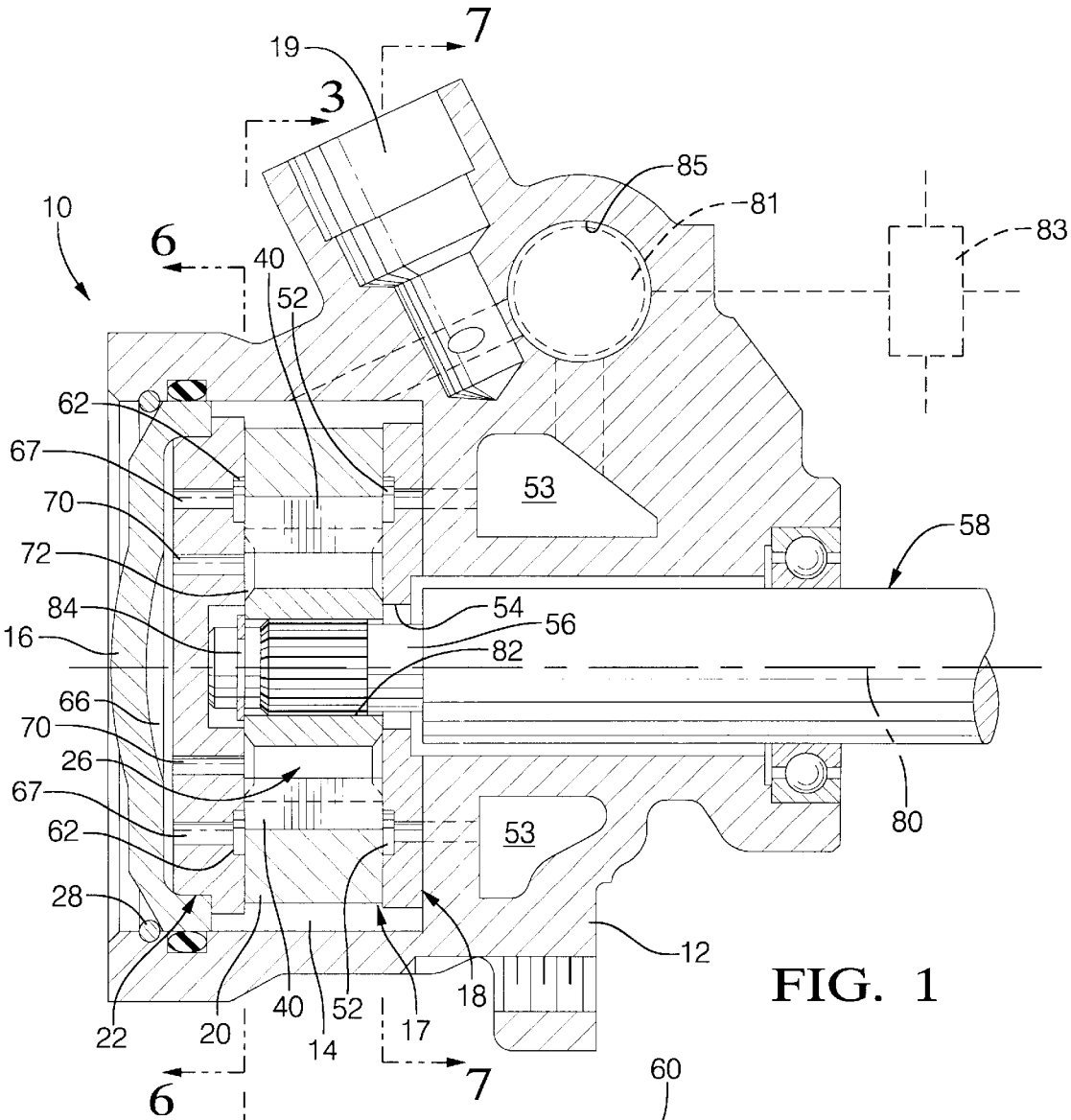
FIG. 1 is a cross -sectional view of a power steering pump.

Referring now in greater detail to the drawings, there is shown in FIG. 1 a power steering pump 10 for an automotive vehicle having a housing 12 defining a substantially cylindrical inner space 14 closed by an end cap 16. The inner space 14 is sized to accommodate a generally cylindrical vaned pump assembly or rotating group 17 and is supplied with hydraulic fluid through an inlet 19. The pump assembly 17 comprises a thrust plate 18, a cam ring 20, a pressure plate 22 and a multi-vaned pump rotor 26 mounted within the cam ring 20 and sandwiched between the disc-like thrust and pressure plates.

The end cap 16 is secured in the housing by a retaining ring 28 expanding into an internal annular groove at the outer end of the cylindrical space formed in the housing. The thrust plate 18, cam ring 20 and the pressure plate 22 are maintained in fixed axial and angular alignment by a pair of elongated pins or screws 30 which extend through openings 29, 31, 33 respectively in these components from anchorage openings in the housing 12 and the end cap 16.

Figure 3:
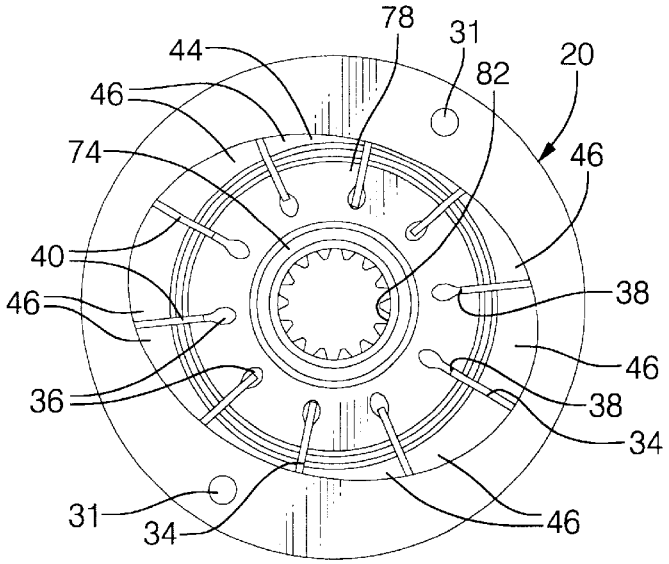
FIG. 3 is a side view taken generally along the sight lines 3—3 of FIG. 1.

The rotor 26 is a generally cylindrical unit that is rotatably supported within the cam ring 20 and is formed with a plurality of vane slots 34. These vane slots extend transversely through the rotor and radiate from a circular arrangement of undervane passages 36 passages arranged in a circular pattern on the cylindrical body of the rotor. The undervane passages 36 also extend transversely through the rotor and are adapted to receive the hydraulic fluid that exerts an outward directed and spring-like radial force imposed on the bottom surfaces 38 of the blade-like vanes 40 that are mounted for reciprocating movement in the vane slots as is known in this art. As best shown in FIG. 3 the outer tips of the blades sealingly engage the inner cam surface 44 of the cam ring during pump operation. This vane engagement is effected by the centrifugal forces developed during rotor rotation and by the radial force exerted on the vanes by the undervane hydraulic pressure as the pump is being driven. With the tips operatively engaging the inner surface of the cam ring an endless series of fluid pumping chambers 46 is formed between adjacent vane members.

Figure 2:
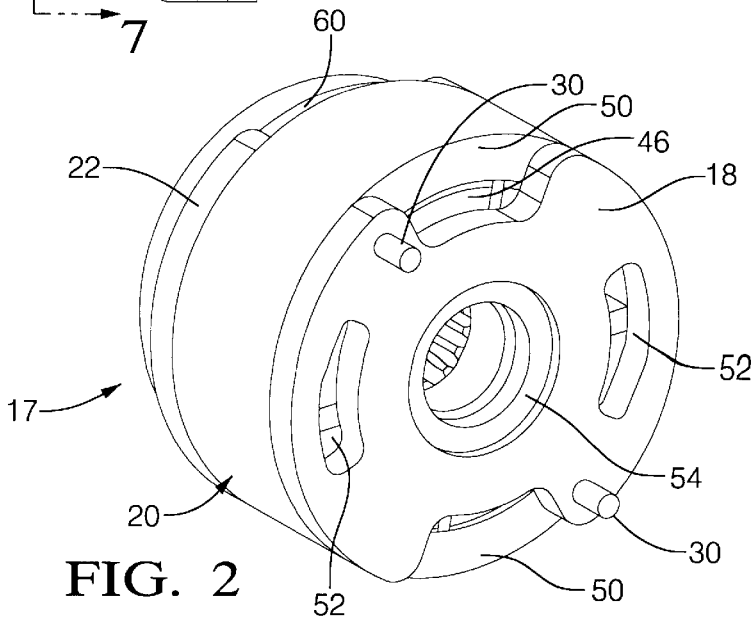
FIG. 2 is a pictorial view of the internal vaned pump assembly of FIG. 1.
Figure 7:
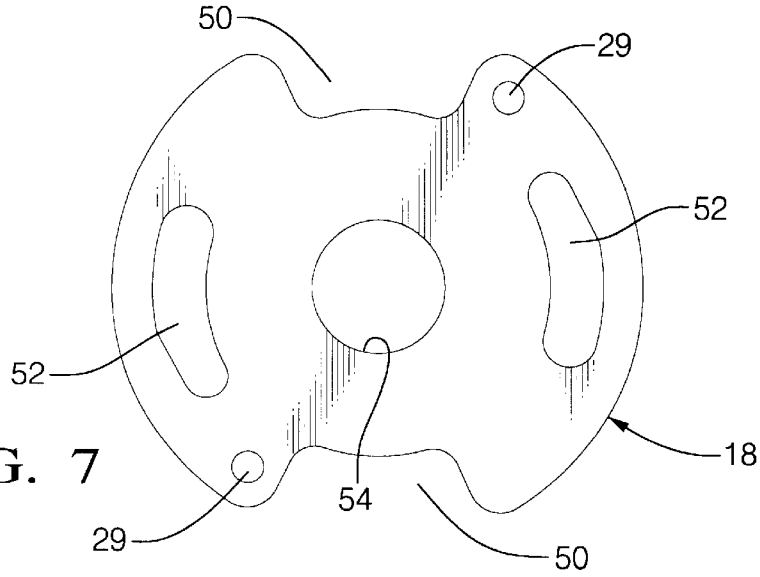

The thrust plate 18 and the pressure plate 22 cooperate with the rotor, vanes and the cam ring to define the axial extent of the fluid chambers 46 formed between adjacent vanes 40. As best shown in FIGS. 2 and 7, the thrust plate 18 has a pair of diametrically opposed inlet ports 50 notched from the circumference of the body of the thrust plate and a pair of diametrically opposed discharge ports 52. These thrust plate discharge ports extend through the thickness of the thrust plates and are in hydraulic communication with the pump discharge chamber 53 in housing 12 as diagrammatically shown in FIG. 1. The thrust plate is further formed with a centralized annular opening 54 to accommodate the reduced diameter and splined end 56 of an elongated input shaft 58 extending therethrough that supports and rotationally drives the rotor.

The pressure plate 22 (FIGS. 2 and 6) has a pair of diametrically opposed inlet ports 60 notched in the periphery thereof which are axially aligned with the inlet ports 50 of the thrust plate. The pressure plate further has a pair of diametrically opposed undervane discharge ports 62 which are arcuately spaced from the inlet ports 60 that align with the discharge ports 52 of the thrust plate as diagrammatically shown in FIG. 1. However, the cam ring is solid in this area so that there is no flow of pressure from the pressure plate ports 62 to the thrust plate discharge ports as in many prior constructions. As will be further explained, this solid construction augments undervane pressurization. More particularly, the discharge ports 62 of the pressure plate hydraulically communicates with an undervane fluid pressure chamber 66 formed outboard of the pump assembly between the pressure plate and the end cap 16. Such communication is through the discharging pressure communication holes 67 extending axially from the discharge ports through the pressure plate body. Moreover the pressure chamber 66 formed to the outboard side of the rotor assembly hydraulically connects to the undervane passages 36 through the axially extending fluid feed passages 70 extending axially through the width of the pressure plate and located radially inward of the discharge holes 67.

Figure 4:
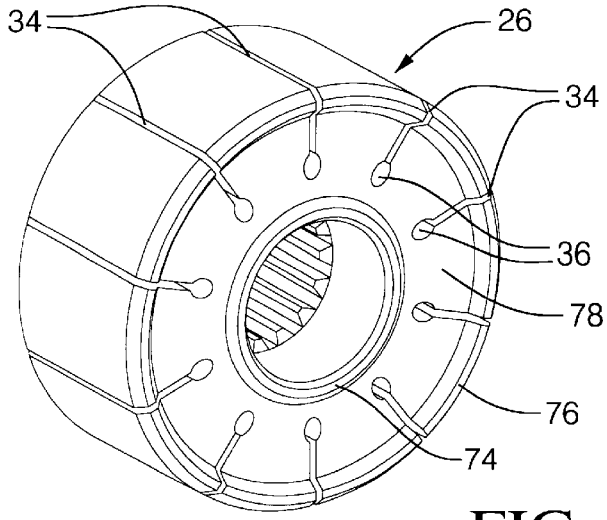
FIG. 4 is a pictorial view of the rotor of FIGS. 1 and 2.
Figure 5:
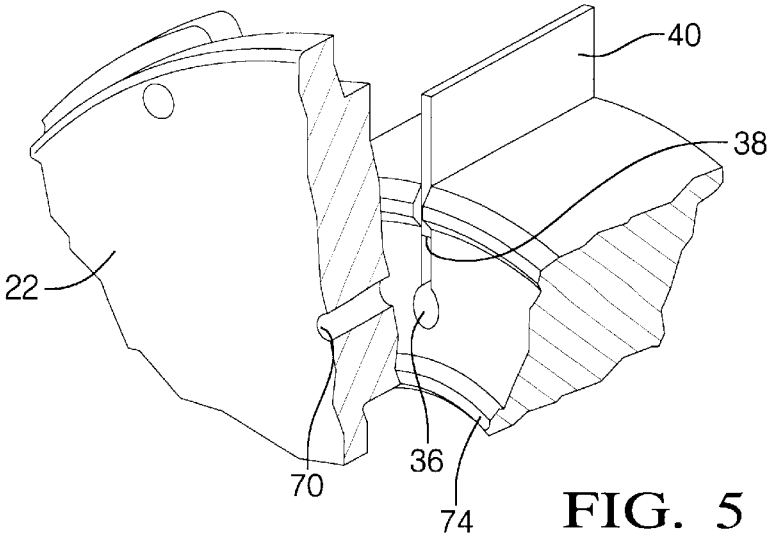
FIG. 5 is a pictorial fragmented view of a portion of the pressure plate, the rotor and associated vane of FIGS. 1–4.
Figure 6:
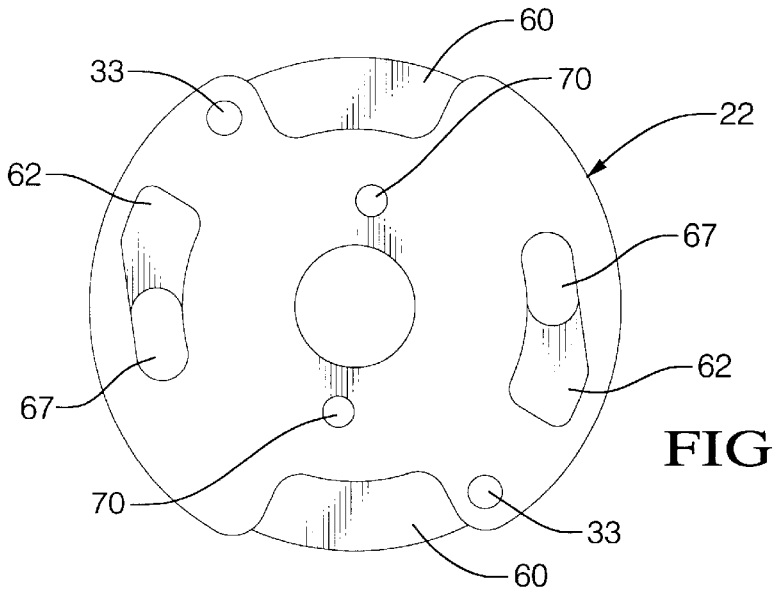
FIGS. 6 and 7 are interior side views of the pressure and thrust plates respectively taken generally along sight line 6—6 and 7—7 respectively of FIG. 1.

These feed passages 70 are preferably simple, straight through, fixed-diameter bores drilled or otherwise formed in the pressure plate as best shown in FIGS. 1 and 6 and function to discharge fluid directly into the outboard side chamber or pocket 72 of the rotor. This side chamber 72 is a pressure balance chamber formed between the pressure plate and concentric inner and outer annular lands 74, 76 formed on the outboard side of the rotor as best shown in FIGS. 3–5. The opposite or inboard side of the rotor has the same construction as the outboard side and cooperates with the thrust plate 18 to define an annular inboard side pressure balance chamber 78. Accordingly both sides of the rotor are substantially the same in construction and the balancing chambers are interconnected by the undervane passages 36 so that pressure balance of the rotor may be achieved.

The pressure plate feed ports or passages 70 are designed to feed pressure fluid from the outboard system pressure chamber 66 to charge the outboard side balance chamber 72, the undervane passages 36 and the inboard side balance chamber 78 as defined by the concentric lands such as 74 and 76. Pressure in the undervane passages 36 provides the radial spring force that urges the vanes 40 radially outwardly against the interior cam surface of the cam ring.

The rotor 26 is rotatably driven about its rotational axis 80 by the elongated input shaft 58 that extends into the housing 12 and through the thrust plate and has it's inner end splined to drivingly fit the internal splined hub 82 of the rotor 26. The rotor is axially retained on the input shaft by a snap ring 84 fitted in an end groove at the terminal end of the shaft 58.

The end cap 16 with the help of system pressure (when pump is operating) holds the pressure plate 22, cam ring 20 and thrust plate 18 in the operative abutting relationship shown in FIG. 1. The inner and outer lands 74, 76 on the sides of rotor act as sliding face seals cooperating with the flat internal faces of the pressure and thrust plates to form the opposing side face and pressure balancing chambers 72,78 with improved internal fluid sealing between these pump components.

When the input shaft 58 is driven by the vehicle engine through a belt or other drive, the chambers 46 between the adjacent vanes 40 will expand as they take in fluid from chamber 14 through the axially aligned inlet ports 60, 50 of the pressure and thrust plates. The vane chambers 46 contract when discharging fluid into the axially aligned discharge ports 52 and 62 of the pressure and thrust plates. While the undervane is effectively separated and charged with construction of this invention, the pump effectively pumps hydraulic fluid into the discharge chamber 53 and to the power steering gear 83 or other accessory through a pressure regulating valve 81 operatively mounted in chamber 85. The varying fluid volumes under the reciprocating vanes will be exchanged in accordance with vane position during pump operation so that the undervane passages remain full of pressure oil during pump operation.

Figure 8:
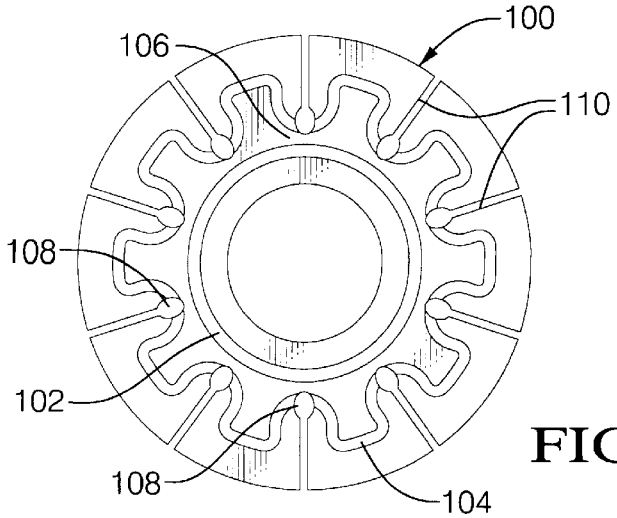
FIG. 8 is a side view of another hydraulic balanced rotor for this invention.

FIG. 8 illustrates another preferred hydraulically balanced rotor 110 which can be used in place of rotor 26. The rotor 100 has inner annular land 102 and an outer land 104 generally serpentined in plan view. These lands define a side pressure balancing pocket 106 which connects to the undervane 108 at the end of each vane slot 110. The reverse side of the rotor is the same as that shown so that equal balancing pockets are formed on opposite sides of the rotor which are connected to the undervane.

This invention accordingly provides for improved undervane routing and pressurization without the complexities of the prior art arrangement of undervane slots and passages and their interconnection along with the requirement for making pressure and thrust plate pump components from powder metal and associated forming tools. Moreover, the pump components of this invention such as the thrust and pressure plates can be made from more economical casting and stamping equipment.

Having described and illustrated some preferred embodiments of our invention, other embodiments will now be now apparent to those skilled in the art which are defined in the following claims.

We claim:

1. A sliding vane hydraulic pump comprising a housing having an undervane pressure chamber, a fluid pumping rotor operatively mounted in said housing for pumping hydraulic fluid supplied to an input leading into said housing to an output therein, a cam ring secured in said housing having an internal cam surface facing said rotor, said rotor having a plurality of arcuately spaced and radially extending vane slots therein, a sliding vane operatively mounted in each said slots and having an outer tip for sliding contact with said internal cam surface, said vanes having interior end surfaces cooperating with said slots to define undervane fluid passages adapted to be pressurized with hydraulic fluid that exerts a radial outward force on said vanes for effecting the operative engagement of the tips of said vanes with said cam surface, and laterally spaced pressure and thrust plates operatively mounted at radially fixed positions in said housing adjacent to opposite sides of said rotor to define pressure balancing side pockets for said rotor interconnected by said undervane fluid passages, each of said plates having at least one intake slot for feeding fluid into the vanes of said rotor and at least one fluid discharge slot formed therein rotationally downstream with respect to said intake slot, said pressure plate having a first passage therein leading from said discharge slot therein into said undervane pressure chamber and outboard of said pressure plate and a second passage therein radially inward of said first passage leading from said undervane pressure chamber into said side pockets of said rotor for the simultaneous pressurization of all of said undervane passages.

2. A hydraulic pump comprising a housing having an undervane pressure chamber therein, a rotor operatively mounted for rotation in said housing, a cam ring fixed in said housing surrounding said rotor, said cam ring having an internal cam surface facing said rotor, said rotor having a generally cylindrical body formed with a side pocket, a plurality of arcuately spaced and radially extending vane slots therein, a vane operatively mounted in each of said slots for contacting said cam surface, said vanes further cooperating with said slots to define undervane fluid passages connected to said side pocket that when pressurized with hydraulic fluid exert a radial outward force on said vanes for effecting the hydraulic priming of said pump, and laterally separated pressure and thrust pates operatively mounted at radially fixed positions in said housing adjacent to opposite sides of said rotor, each of said plates having at least one fluid intake slot for feeding fluid into said vanes of said rotor and at least one fluid discharge slot formed therein downstream of said intake slot for receiving fluid from said vanes of said rotor, a passage leading from said discharge slot of said pressure plate into said undervane pressure chamber and a second passage in said pressure plate radially inward of said first passage leading from said undervane pressure chamber to said side pocket of said rotor for the substantial simultaneous feeding of fluid to all of said undervane passages for effecting the operative engagement of said vanes with said interval cam surface.

3. The pump of claim 2 in which said side pocket of said rotor is defined by radially separated lands respectively located radially inward and outward of said undervane passages.

4. A self-priming, pressure-balanced, sliding-vane hydraulic pump comprising a housing, a rotor operatively mounted for rotation in said housing, a drive shaft extending into said housing for rotatably driving said rotor, said rotor having a generally cylindrical body with a circular outer periphery, said rotor having a plurality of vane slots therein extending in spoke-like fashion through the periphery of said rotor, a cam ring fixed in said housing and disposed around said rotor, said cam ring having an endless annular inner cam surface facing the periphery of said rotor, a vane operatively mounted in each of said slots adapted to be operatively engaged by said cam surface, an undervane pressure passage defined by the lower extend of each of said vane slots for accommodating the flow of hydraulic pressure oil therethrough, a thrust plate fixed in said housing adjacent to one side of rotor, a pressure plate adjacent to the other side of said rotor, an undervane charging chamber formed within said housing and adjacent to the outer side of said pressure plate, said pressure and thrust plate having hydraulic fluid intake ports for admitting fluid into the pumping chambers of said rotor, and discharge ports for receiving pumped fluid from said pumping chambers of said rotor, said pressure plate having a first straight-through passage therethrough leading from said discharge ports to said undervane charging chamber and a second straight-through passage leading from said undervane charging chamber to said undervane pressure passages so that all the undervane pressure passages are charged with pressure fluid to urge the vanes in an outward direction and into engagement with said cam surface.

5. The pump construction of claim 4 wherein said second passage is of substantially constant diameter from said undervane charging chamber to said undervane pressure passages.

* * * * *